US006406356B1

(12) United States Patent
Brooks

(10) Patent No.: US 6,406,356 B1
(45) Date of Patent: Jun. 18, 2002

(54) WHEEL FINISHING APPARATUS AND METHOD

(76) Inventor: Frederick E. Brooks, 960 Verona Dr., Fullerton, CA (US) 92635

( * ) Notice: Subject to any disclaimer, the term of this patent is extended or adjusted under 35 U.S.C. 154(b) by 0 days.

(21) Appl. No.: 09/803,204

(22) Filed: Mar. 12, 2001

(51) Int. Cl.[7] ..... B24B 1/00

(52) U.S. Cl. ..... 451/36; 451/104; 451/106; 451/113

(58) Field of Search ..... 451/36, 32, 104, 451/35, 106, 113, 328, 326, 327

(56) References Cited

U.S. PATENT DOCUMENTS 4,173,851 A * 11/1979 Higashi
4,581,853 A * 4/1986 Marcus
4,615,145 A 10/1986 Matsumoto et al.
4,706,414 A * 11/1987 Muzik
5,088,238 A * 2/1992 Lin
5,857,901 A 1/1999 La Point
6,280,303 B1 * 8/2001 Kawasaki ..... 451/104

* cited by examiner

*Primary Examiner*—Eileen P. Morgan
(74) *Attorney, Agent, or Firm*—Edgar W. Averill, Jr.

(57) ABSTRACT

A wheel finishing apparatus for abrasively finishing the front faces of automobile wheels. The apparatus has a rotating carousel hub and multiple arms connected to the carousel hub which extend out to wheel mounting ends. A wheel is rotatably mounted to each wheel mounting end such that the front face of each wheel faces a known direction of carousel rotation and forms an impingement with an orbital path traversed by the wheel mounting end. Each wheel may be independently pivoted about a respective pivot axis at each wheel mounting end for variably adjusting the impingement angle. By adjusting the impingement angle to less than ninety degrees, partially submerging the wheels in a media bath, and rotating the carousel drive structure about a central axis of rotation, the abrasive polishing media impinges the submerged portions of the front faces and rotates the wheels about their respective wheel rotational axes to abrasively finish all areas of the front faces.

14 Claims, 6 Drawing Sheets

WHEEL FINISHING APPARATUS AND METHOD

BACKGROUND OF THE INVENTION

The field of the invention generally pertains to metal polishing and finishing. The present invention relates more particularly to a wheel finishing apparatus and method utilizing a carousel configuration to orbitally drive multiple wheels through abrasive polishing media, wherein the front face of each wheel is partially submerged in the abrasive polishing media and angled to be impinged at an impingement angle.

The popularity of stylized automobile wheels has been largely attributable to their aesthetic enhancement of automobiles, with chrome wheels in particular providing a more stylish, sporty, and expensive look. In order to provide such an aesthetically pleasing appearance the front face of a wheel must be made as smooth as possible before it is coated or plated with a layer of chrome. If the front face is not smooth, the chrome layer applied thereto acts to enhance and visually magnify any grooves or imperfections remaining in the wheel surface, thereby significantly detracting from the overall appearance of the wheel. Thus, there is a need for a device which may quickly and efficiently remove substantially all the grooves and roughness on the front face of a wheel to provide a front face with the desired degree of smoothness.

One prior method of finishing wheels has been to manually finish wheels by hand. A workman would manually rub an abrasive material against the front face of a wheel, e.g. by means of a hand-held polishing/buffing wheel, which would eventually serve to polish the front face of the wheel. This procedure has proved to be quite tedious, time-consuming, and labor and cost intensive, and thus very inefficient.

Another prior method of finishing wheels is shown in U.S. Pat. No. 5,857,901, showing an automobile wheel finishing apparatus having a vertical spindle mounted on a frame and positioned directly above a media tank. The lower end of the spindle is adapted to vertically mount a single wheel thereon. The single mounted wheel is rotated by the spindle as the media tank is raised to engage the front face of the automobile wheel with the media. The configuration of this apparatus, however, is not free from shortcomings. The particular vertical mounting of the wheel on the spindle and subsequent rotation thereof produces a centrifuge effect propelling abrasive polishing media in a radially outward direction. While suitably finishing the radial fringes of a wheel, this process has proved to be inadequate for finishing the inner surface areas of the front face. Moreover, the single wheel mounting configuration by means of a single spindle can be inefficient for finishing large numbers of wheels in a high volume manner.

In U.S. Pat. No. 4,615,145, a polishing apparatus not specifically geared for wheel polishing is shown having a planetary gear box which simultaneously produces three rotational motions on three separate and distinct axes. As shown in FIG. 1, this arrangement produces an orbiting motion about an orbit path F while simultaneously producing a rotational motion in the direction of r, and although not shown in FIG. 1, a third rotational motion is provided about axle b shown in FIG. 1. Because this particular configuration is designed to polish all surfaces of a work piece, it is largely inadequate and unsuitable for wheel polishing/finishing applications where it is necessary to finish only the front faces thereof for subsequent plating or coating. Furthermore, because wheels have a relatively broad front face, subjecting them to the particular multi-axial rotation disclosed in the '145 patent while completely submerged in abrasive polishing media commonly used in wheel finishing applications, may strain the '145 apparatus which is primarily intended for smaller items such as spoons, ladles, pipes, etc.

Therefore, there is a particular need to provide a wheel finishing apparatus that overcomes the limitations of the prior art with respect to both quality of the finished product, as well as the high-volume efficiency and cost-effectiveness by which wheel finishing operations are performed. The advantages of an improved multi-wheel finishing apparatus is readily and most notably apparent in the potentially substantial cost-savings in manual labor costs in this traditionally labor-intensive industry. Average manual finishing costs per wheel have been known to be as high as sixteen dollars per wheel, which has typically translated to higher prices for consumers and lower profits for manufacturers.

BRIEF SUMMARY OF THE INVENTION

Thus, it is an object of the present invention to provide a simple, improved, and cost-effective wheel finishing apparatus and method configured to more completely polish the front face of the wheel in a high-output, efficient, and cost-effective manner.

It is a further and more particular object of the present invention to provide a wheel finishing apparatus and method arranged in a carousel configuration for perimetrically mounting multiple wheels thereon to concurrently impinge and finish the front faces of the multiple wheels in an abrasive polishing media.

It is a still further object of the present invention to provide a wheel finishing apparatus and method designed to cyclically submerge portions of the front faces of wheels in abrasive polishing media whereby improved operational performance may be realized due to overall decrease in drag, higher impingement speeds and abrasive impact forces, and shorter operation cycles.

It is a still further object of the present invention to provide a wheel finishing apparatus and method which automatically rotates mounted wheels such that all areas of the front face of the wheel are finished evenly without producing variations in finish quality.

The present invention is for a wheel finishing apparatus for abrasively finishing wheels having front faces. In a preferred embodiment, the wheel finishing apparatus has a frame and a carousel hub rotatably connected to the frame for rotating about a central axis of rotation. The carousel hub is preferably connected to the frame by means of a spindle which suspends the carousel hub from the frame. At least one carousel arm is fixedly connected to the carousel hub, each extending to a wheel mounting end remotely spaced from the central axis. Preferably, a plurality of carousel arms are provided by which multiple wheels may be mounted thereon. The carousel hub and arms are rotated together by means for rotating the carousel hub about the central axis of rotation in a known rotational direction. In this manner, the carousel hub and arms are rotated such that the wheel mounting end traverses an orbital path around the central axis of rotation. Rotation of the carousel hub and arms is preferably accomplished by a carousel motor connected to the spindle. The wheel finishing apparatus also has means for rotatably mounting a wheel to each wheel mounting end with the front face of each mounted wheel facing the known rotational direction and each mounted wheel having a wheel rotational axis oriented normal to the front face. The front face forms an impingement angle with the orbital path, which is preferably less than 90 degrees to produce a rotational moment exerted on a submerged portion of the mounted wheel during the finishing operation. Preferably, and in a second preferred embodiment, means for rotating the mounted wheel is provided by which the wheel is rotated about the wheel axis of rotation regardless of the impingement angle. Furthermore a tank is provided having an open end for storing abrasive polishing media. And means for partially submerging the mounted wheel in the abrasive polishing media is provided, which preferably includes hydraulic means for moving the tank and the wheel mounting ends relative to each other between engaged and disengaged positions. In the disengaged position, the wheels mounted on the wheel mounting ends are not submerged in the abrasive polishing media such that an operator may load and unload wheels from the wheel finishing apparatus. And in the engaged position, the mounted wheels are extended into the open end of the tank and are partially submerged in the abrasive polishing media such that the submerged portion of the front face of the mounted wheel is abrasively impinged by the abrasive polishing media at the impingement angle.

The present invention is also for a wheel finishing system for abrasively finishing wheels having front faces. The wheel finishing system comprises a wheel mounting structure having means for rotatably mounting at least one wheel thereon, with the at least one mounted wheel having a wheel axis of rotation normal to the front face. Additionally, the system also comprises a tank having an open end, for storing abrasive polishing media. Means for partially submerging the at least one mounted wheel in the abrasive polishing media is also provided so that a submerged portion of the front face is in contact with the abrasive polishing media. And finally, means for relatively moving the at least one partially submerged wheel through the abrasive polishing media in a known direction of relative motion is provided with the at least one partially submerged wheel angled to impinge the submerged portion of the front face at an impingement angle less than ninety degrees. The impingement angle is defined between the known direction of relative motion and the front face of the at least one partially submerged wheel. In this manner, when the at least one mounted wheel is partially submerged in the abrasive polishing media and relatively moved therethrough in the known direction of relative motion, the abrasive polishing media exerts a rotational moment against the submerged portion of the front face to rotate the partially submerged at least one wheel about its wheel axis of rotation and impinge all areas of the front face in a cyclical manner.

And finally, the present invention is also for a method of abrasively finishing wheels having front faces. The method provides for rotatably mounting at least one wheel onto a wheel mounting structure, such as the carousel hub and arms combination described above. The at least one mounted wheel is partially submerged in the abrasive polishing media such that a submerged portion of the front face is in contact with the abrasive polishing media. Then, the partially submerged wheels are relatively moved in a known direction of relative motion through the abrasive polishing media at the impingement angle formed between the front face of the partially submerged wheel and a known direction of relative motion. This causes the abrasive polishing media to impinge the submerged portion of the front face at the impingement angle. Where the impingement angle is less than ninety degrees, the abrasive polishing media causes rotation of the wheel along the wheel axis of rotation to evenly finish all areas of the front face.

DESCRIPTION OF THE PREFERRED EMBODIMENTS

Figure 1:
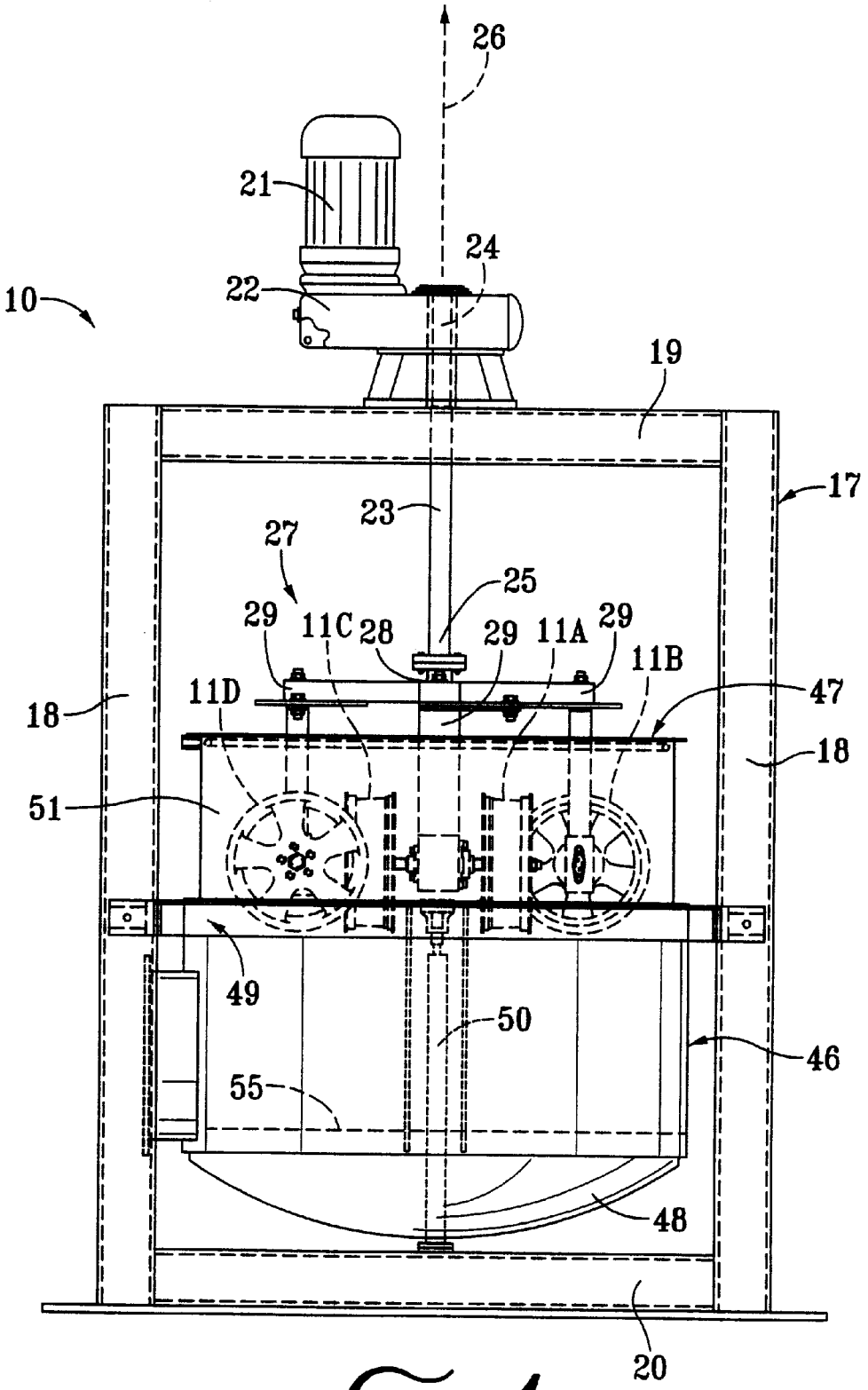
FIG. 1 is a side view of the wheel finishing apparatus, in the non-operating position.
Figure 2:
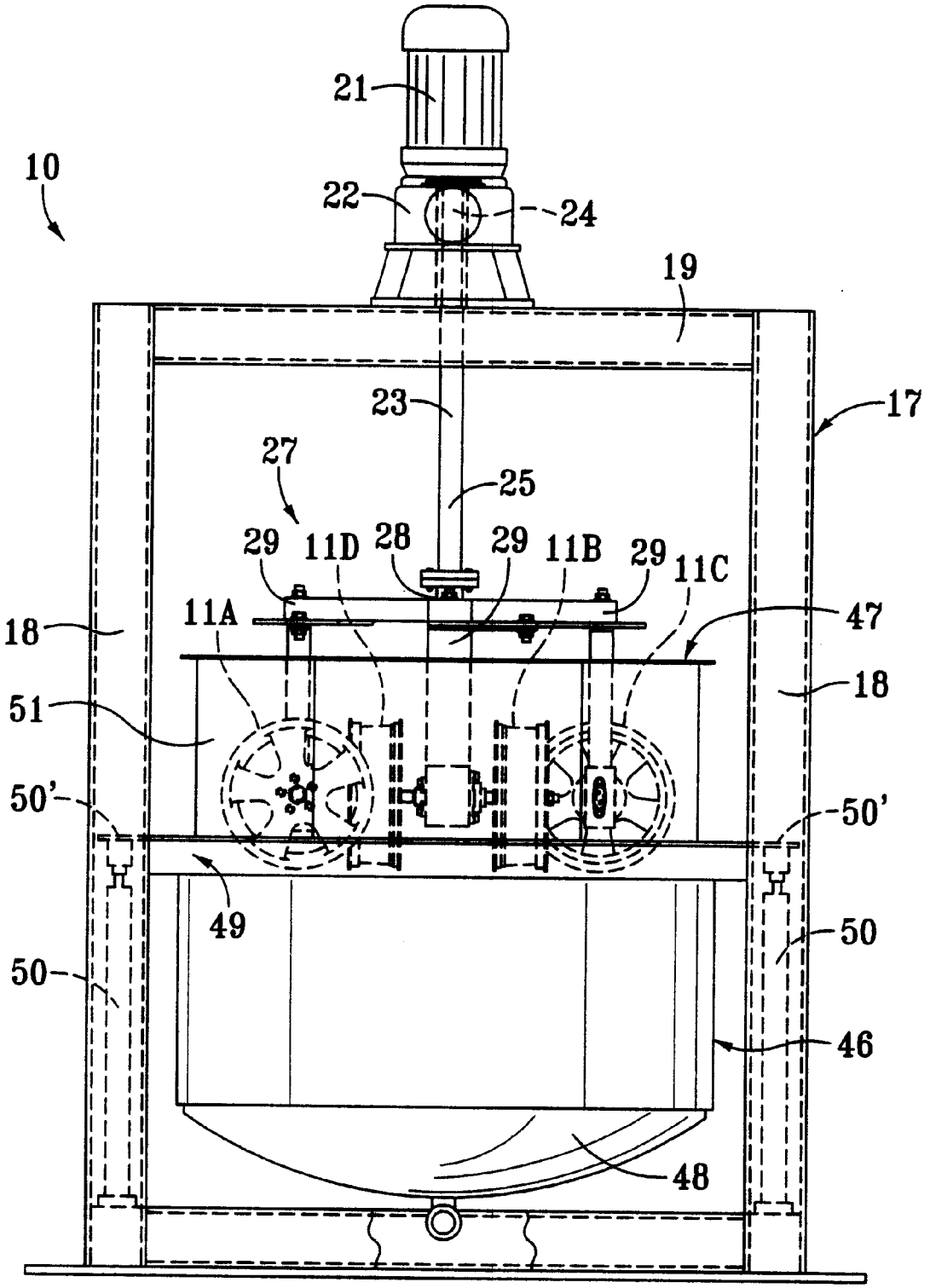
FIG. 2 is a front view of the wheel finishing apparatus also in the non-operating position.
Figure 3:
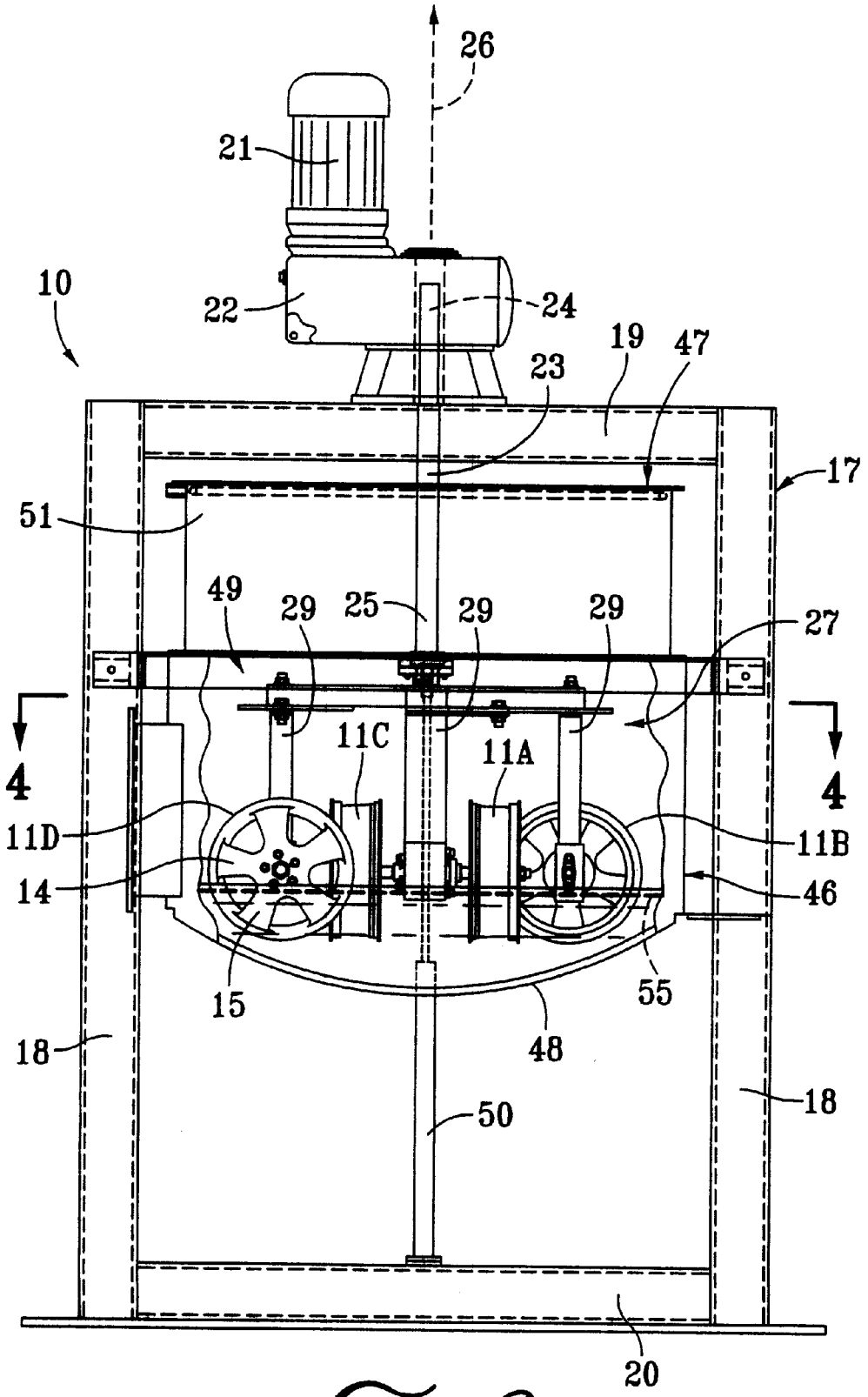
FIG. 3 is a side view of the wheel finishing apparatus in the operating position, and with the tank partially broken to illustrate the partial submersion of the wheels in the abrasive polishing media bath.

Referring now to the drawings, FIGS. 1–3 show the complete wheel finishing apparatus generally represented at reference character 10. The wheel finishing apparatus 10 is of the type used to polish and finish the front faces 12 (FIGS. 5 and 10) of automobile wheels 11 as a preparatory step to plating or coating the front face 12 with an aesthetically pleasing outer coating. Typically chrome is plated on the front faces 12 in a conventional plating process. Alternatively any suitable coating or plating material known in the wheel manufacturing industries may be applied to produce a glossy or lustrous surface. In any case, it is notable that automobile wheels may be constructed from a rigid, lightweight metal or alloy, such as aluminum, which is cast or otherwise manufactured in a manufacturing process known in the wheel manufacturing industry.

Figure 4:
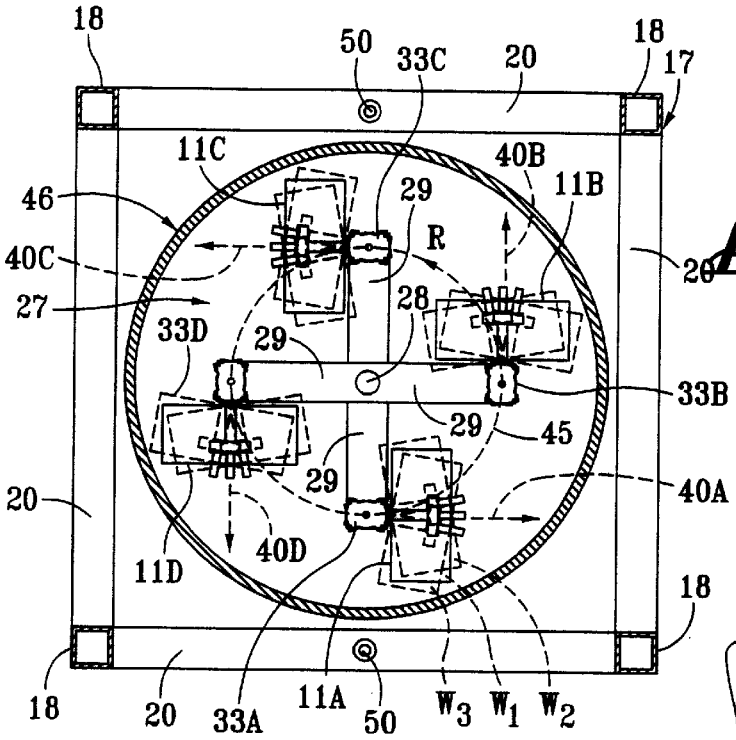
FIG. 4 is a cross-sectional top view of the wheel finishing apparatus taken along line 4—4 of FIG. 3.

As can be best seen in FIGS. 1–4, the wheel finishing apparatus 10 comprises a frame, generally indicated at reference character 17, having a rigid and preferably box-like skeletal construction positioned on a relatively level support surface. The frame 17 has corner columns 18 which provide vertical support to the frame 17 along its four corners. As shown in FIG. 4, base beams 20 transversely connect each of the four corner columns 18 at their respective lower ends. Alternatively, however, a single base platform (not shown) may be utilized upon which the four corner columns 18 may be rigidly connected. The upper ends of the four corner columns 18 may also be connected by upper transverse beams similar to the base beams 20 connecting the lower ends. However, the upper ends of the four corner columns 18 are preferably rigidly joined by a top platform 19 utilized in supporting a motor 21 thereon, as will be discussed in detail below. The frame 17 is preferably constructed from steel or other rigid body construction for providing operational stability to support heavy loads and withstand vibrations associated with the finishing process. To this end, the frame may be additionally secured to the level support surface, such as commonly found in machine shops, manufacturing plants, etc. The open skeletal construction of the frame 17 enables convenient access to the carousel structure, as will be discussed next, for loading and unloading of wheels 11 to be finished.

The wheel finishing apparatus 10 has a carousel hub 28, shown in FIGS. 1–6, which is rotatably connected to the frame 17. The carousel hub 28 has a central axis of rotation, indicated at reference character 26 in FIGS. 1 and 3, about which the carousel hub 28 rotates. And the carousel hub 28 is preferably suspended from the frame 17 by means of an elongated spindle 23 having an upper spindle end 24 rotatably connected to the top platform 19 of the frame 17, and a lower spindle end 25 fixedly connected to the carousel hub 28. In this preferred arrangement, a conventional bearing such as a thrust bearing (not shown) is used to connect the upper spindle end 24 to the frame. In this manner, the spindle 23 serves to enable rotating connection of the carousel hub 28 to the frame 17 while sufficiently spacing the carousel hub 28 from the top platform 19 of the frame 17. While use of the spindle 23 is preferred to establish rotational connection between the carousel hub 28 and the frame 17, it is not limited only to such. It is appreciated that other dynamic mechanical arrangements and methods of providing rotating connection to the frame 17 is also contemplated as known in the mechanical arts.

As can be further seen particularly in FIGS. 1–6, at least one carousel arm 29 is connected to a joint-like carousel hub 28. Preferably a plurality of carousel arms 29 are utilized, each connected to the carousel hub 28 in a fixed manner to rotatably move each carousel arm 29 together with the carousel hub 28. As can best be seen in the preferred arrangement shown in FIG. 4, four carousel arms 29 extend from the drive hub 28 in an equilateral cross configuration. In any case, each carousel arm 29 extends from the carousel hub 28 to a wheel mounting end 32 (FIG. 6) which is remotely spaced from the central axis of rotation 26. As particularly shown in FIG. 6, each carousel arm 29 preferably has a radially extending transverse or swing portion 30 providing the radial spacing from the central axis of rotation 26. And a downwardly extending portion 31 is preferably connected to the end of the swing portion 30 extending down to the wheel mounting end 32. While not limited to this two-part configuration of the carrousel arm 29, it illustrates an important function of the carrousel arm 29 which is to radially space each wheel mounting end 32 from the central axis of rotation 26. It is appreciated that the carousel hub 28 and carousel arms 29 may be variously configured and designed to effect the radial spacing of the wheel mounting ends 32. For example, a one-piece carrousel arm (not shown) diagonally extending from the joint-like carousel hub 28 may be utilized to effect the required radial spacing. As a second example, the carousel hub itself may have a disc-shaped configuration (not shown) for providing the radial spacing of the wheel mounting end from the central axis of rotation, with the carousel arms 29 being a one-piece vertical arm downwardly extending from the disc-shaped hub. In any case, the carousel hub 28 and the carousel arms 29 function together to radially space the wheel mounting ends 32 from the central axis of rotation 26, while also preferably extending the wheel mounting ends 32 below the carousel hub 28.

As shown in FIGS. 1–3, a motor 21 is positioned on the top platform 19 of the frame 17 and is dynamically connected to the upper end 24 of the spindle 23 to rotatably drive the spindle 23 and the carousel hub 28 in a known direction of carousel rotation, indicated at arrow R in FIG. 4. In particular, rotation of the carousel hub 28 causes the wheel mounting ends 32 of the carousel arms 29 to traverse an orbital path 45 around the central axis of rotation 26. It is notable that the motor 21 is preferably an AC or DC electric motor generating sufficient torque to rotatably drive the spindle 23, the carousel hub 17, and the carousel arms 29. While experiments conducted by the applicant suggest a DC motor generating approximately 40 horsepower is sufficient to drive four carousel arms 29 having wheels 11 mounted thereto at 20–50 rpm, power requirements of the motor 21 may vary depending upon the particular configuration of the wheel finishing apparatus 10 and its application. Additionally, a transmission gearbox 22 is preferably utilized to provide gear reduction. The transmission gearbox functions to convert high-rpm input of the motor 21 to a high-torque, rotational moment output at the upper spindle end 24 of the spindle 23. For example, in the four wheel preferred arrangement discussed above, a 36:1 gear ratio is utilized with the 40 horsepower motor to produce a spindle rpm ranging from 20–50 rpm. Gear reduction is preferred in order to overcome the impingement drag inherently and necessarily produced in the present wheel finishing apparatus 10. However, as will be discussed in greater detail below, the partial submersion of the wheel 11 to be finished significantly reduces the impingement drag during operation, and consequently reduces the minimum power and torque requirements as well.

Figure 6:
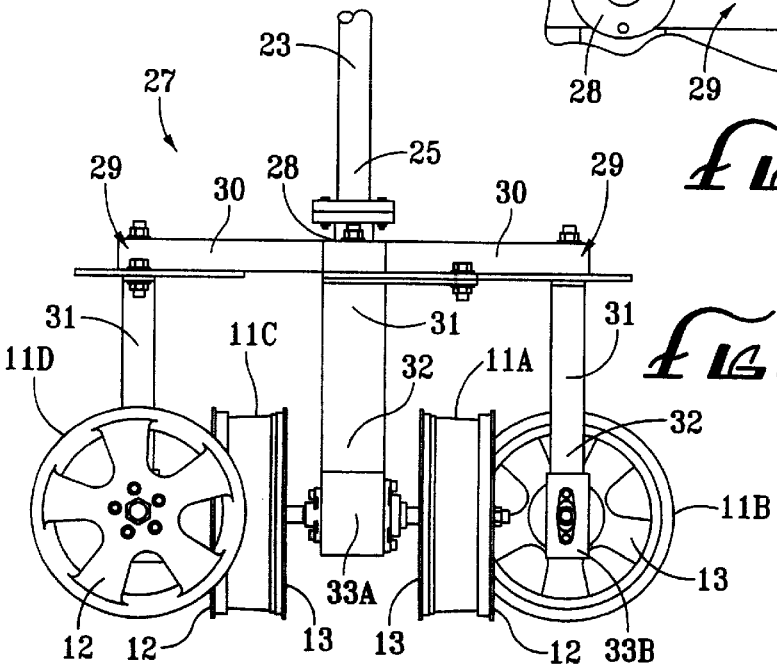
FIG. 6 is an enlarged side view of the carousel hub assembly alone, showing in detail the carousel hub components and the orientation of the mounted wheels.
Figure 8:
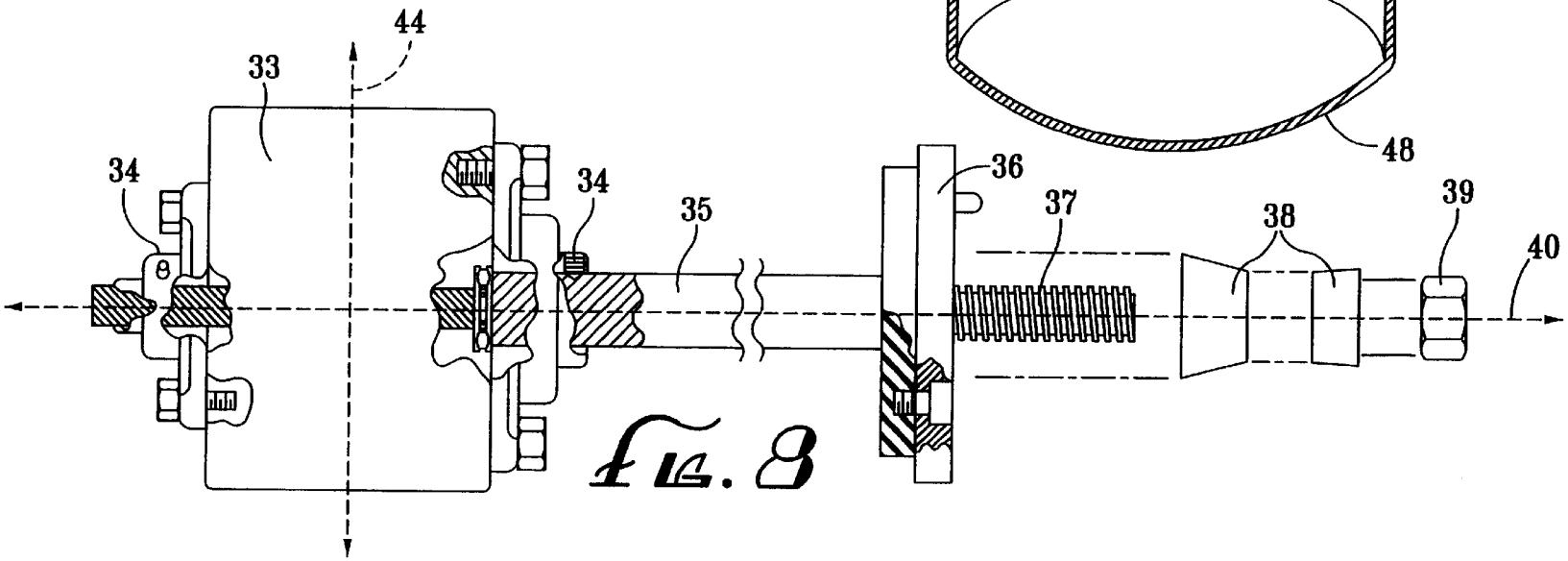
FIG. 8 is a layout view of a mounting assembly for mounting a wheel to a wheel mounting end.

As can be best seen in FIGS. 4 and 6, each of the wheel mounting ends 32 of the carrousel arms 29 has a wheel mounting assembly connected thereto, comprising primarily of a wheel axle support structure 33. In the four wheel preferred configuration, wheels 11A, 11B, 11C and 11D are rotatably mounted on wheel axle support structures 33*a*, 33*b*, 33*c* and 33*d*, respectively. In particular, and as shown in FIG. 8, each wheel axle support structure 33 supports a wheel mounting axle 35 thereon, with the wheel mounting axle 35 defining a wheel axis of rotation 40. The wheel mounting axle 35 rotatably connects to the wheel axle support structure 33 by axle bearings 34 which are preferably a journal bearing and a thrust bearing combination. The conventional journal bearing functions to support transverse loads to enable axial rotation of the wheel axle 35 about the wheel axis of rotation 40. And the thrust bearing functions to support axial loads produced along the wheel axis of rotation 40 during the finishing operation. The wheel mounting axle 35 preferably extends to a threaded end 37 adapted to threadedly receive a wheel mounting nut 39. Furthermore, the wheel mounting axle 35 has a back support plate 36 connected at the neck of the wheel mounting axle 35 against which a back side 13 (FIG. 6) of a wheel 11 abuts when mounted. And centering rings and/or washers 38 may be provided to center the wheel 11 on the wheel mounting axle 35. In this manner, a wheel 11 may be mounted on the wheel mounting axle 35 with the back side 13 of the wheel 11 abutting against the back support plate 36, and upon which the wheel mounting nut 39 is secured on the threaded end 37. Thus, the mounted wheel 11 is allowed to rotate together with the wheel mounting axle 35 relative to the respective wheel mounting support structure 33.

As can be seen in FIG. 4, the wheels 11A–D are mounted on corresponding wheel axle support structures 33A–D such that each of the front faces (FIG. 5) thereof generally face the known direction of carousel rotation R. In FIG. 4, the known direction of carousel rotation R is shown in the counter-clockwise direction, but is not limited only to such. Each wheel mounting axle 35 extends out from the corresponding wheel axle support structure 33 in the known direction of carousel rotation R such that the mounted wheel 11 is positioned ahead of the wheel axle support structure 33 (see FIG. 5). It is notable that the wheel axis of rotation 40 of the mounted wheel 11 is normal to the front face 12 (shown in FIGS. 9 and 10). Additionally the front face 12 (FIG. 6) forms an attack or impingement angle θ (see FIGS. 10A–C) with the known direction of carousel rotation R, represented by the orbital path 45, which will be discussed in greater length below.

Figure 5:
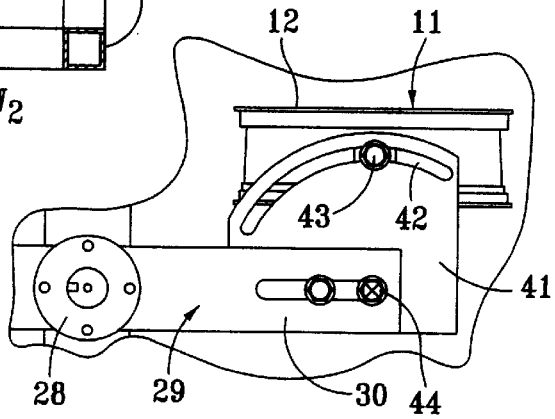
FIG. 5 is an enlarged top view of the pivot assembly at one of the carousel arms.

While the wheel mounting axle 35 and the wheel axis of rotation 40 of each wheel 11 is generally tangential to the known direction of carousel rotation R, also represented by the orbital path 45, it is understood that limited angular variations of each wheel axis of rotation 40 are not precluded. Preferably, each wheel mounting assembly has means for pivoting the mounted wheel 11 about a corresponding pivot axis 44, shown in FIG. 8. And each pivot axis 44 is generally parallel to the central axis of rotation 26. General speaking, the pivot axis 44 has a generally vertical orientation whereby the wheel mounting axle 35 and the wheel axis of rotation 40 are pivoted along a generally lateral plane normal to the pivot axis 44. As shown in FIG. 5, pivoting movement of the mounted wheel 11 is accomplished by providing an adjustment plate 41 connected to carousel arm 29, and having an adjustment slot 42 with an arc-shaped configuration. A set screw 43 partially extends through the adjustment slot 42 and is adapted to pivot together with the mounted wheel 11 about the pivot axis 44. The set screw 43 functions to releasably secure the wheel 11 at a desired impingement angle (see discussion below). In this manner, and as shown in FIG. 4, each wheel 11 may pivot about its corresponding pivot axis 44 to adjust the impingement angle within a pivot range dictated by the adjustment slot 42.

As shown in FIGS. 1–3 and 7, the wheel finishing apparatus 10 also has a tank 46 having a closed lower end 48 and an open end 47. The tank 46 is preferably positioned inside the frame 17 below the carousel structure (carousel hub 28 and carousel arms 29). As can be best seen in FIG. 7, the tank 46 has a lift collar support structure 49 surrounding and secured to the tank 46 at the open end 47. The lift collar support structure 49 has a support flange 50' adapted to engage a hydraulic lift mechanism 50, shown in FIGS. 1–3, whereby the tank 46 may be raised or lowered by the hydraulic lift mechanism 50. As shown in FIGS. 1–4, the hydraulic lift mechanism 50 is preferably secured to opposing base beams 20 of the frame 17 such that raising and lowering of the tank 46 is supported by the frame 17. Furthermore, as can best be seen in FIG. 7, the tank 46 preferably has a shroud 51 surrounding the open upper end 47 of the tank 46. The shroud 51 has an access panel 52 hinged thereon which allows access by an operator to the carousel hub 28 and arms 29. The access panel 52 allows the operator to mount and unmount wheels 11 to the wheel mounting ends 32 of the carousel arms 29 before and after the finishing operation.

Figure 7:
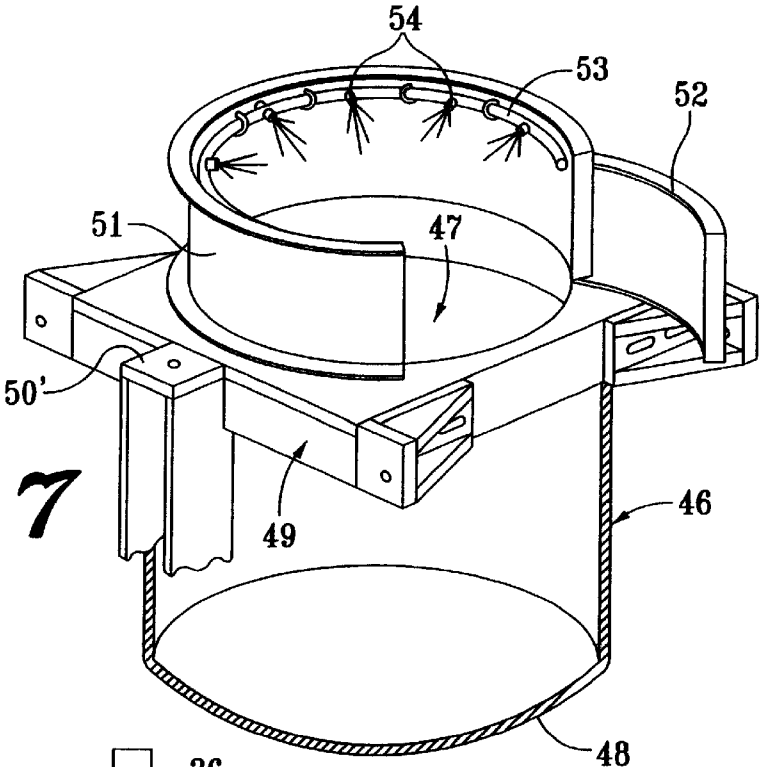
FIG. 7 is a perspective view of the tank and its associated components.

The tank 46 functions to store abrasive polishing media therein. The abrasive polishing media is preferably of a particulate or granular nature having an abrasive surface, which is commonly known and used in the wheel polishing industries. It is notable that water or other additive liquid may be used for wetting, rinsing, and/or lubricating the abrasive polishing media. To this end, and as shown in FIG. 7, the upper rim of the shroud 51 preferably has a sprinkler pipeline or tubing 53 having spray nozzles 54 which spray water and/or lubricating liquid into the tank 46. It is notable that the spray nozzles 54 are generally not provided for filling up the tank 46 to produce a liquid media slurry. Rather, the preferred use of such rinsing or wetting liquid is to wash out eroded media particles after an operation cycle. And as can be best seen in FIG. 3, the tank 46 is filled with abrasive polishing media up to a media fill level, indicated at reference character 55. The media fill level 55 represents a lateral media plane demarcating the upper limit when subjecting the mounted wheels 11 to the abrasive finishing process, as will be discussed next.

Turning now to the method of the wheel finishing operation utilizing the wheel finishing apparatus 10, FIGS. 1 and 2 show the wheel finishing apparatus 10 in the disengaged position. As can be particularly seen in FIG. 1, the mounted wheels 11A–D are sufficiently elevated above the media fill level 55. Moreover, the wheels are elevated sufficiently so that they are positioned adjacent the shroud 51 to enable an operator to open the shroud 51 and gain access to the carousel hub 28 and arms 29. In this regard, the carousel hub 28 may be configured to index the position of each carousel arm 29 whereby each of the carousel arms 29 may successively come to rest adjacent the access panel 52 for loading and unloading wheels therein.

And as shown in FIG. 3, when the wheel finishing apparatus 10 is fully engaged, the wheels 11A–B are partially submerged below the media level line 55 such that only submerged portions 15 of the front faces 12 of the wheels 11 are below the media fill level 55 and in contact with the abrasive polishing media. In contrast, the non-submerged portions 14 of the front faces 12 are situated above the media fill level 55. In this manner, when the wheels 11 are partially submerged in the abrasive polishing media and the motor 21 is activated to spin the spindle 23 about the central axis of rotation 26, the wheels 11 are skimmed through the abrasive polishing media such that only the submerged portions 15 of the front faces 12 of each wheel 11 are impinged thereby.

Figure 9A:
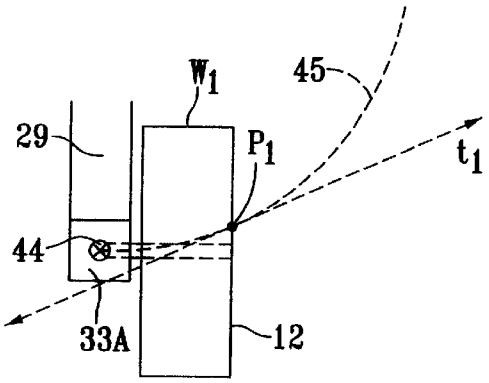
FIG. 9A shows a top view of a representative wheel 11A in a first angular position $W_1$, similar to that shown in FIG. 4.
Figure 9B:
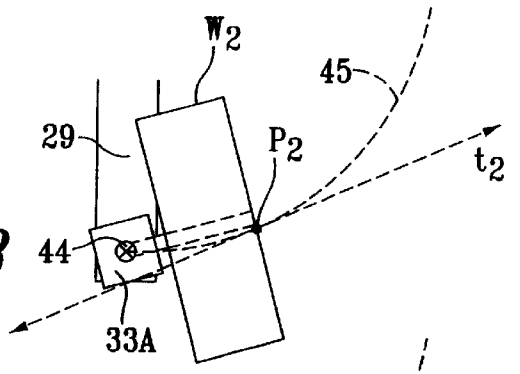
FIG. 9B shows top view of a representative wheel 11A in a second angular position $W_2$, similar to that shown in FIG. 4.
Figure 9C:
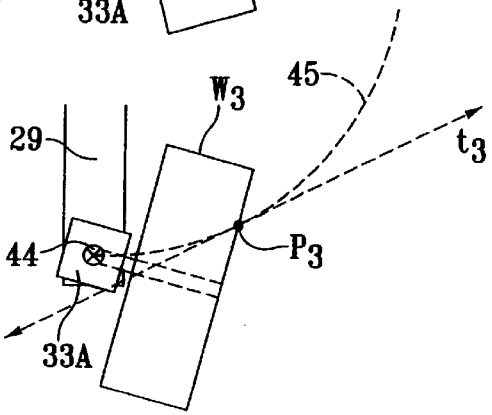
FIG. 9C shows a top view of a representative wheel 11A in a third angular position $W_3$, similar to that shown in FIG. 4.
Figure 10A:
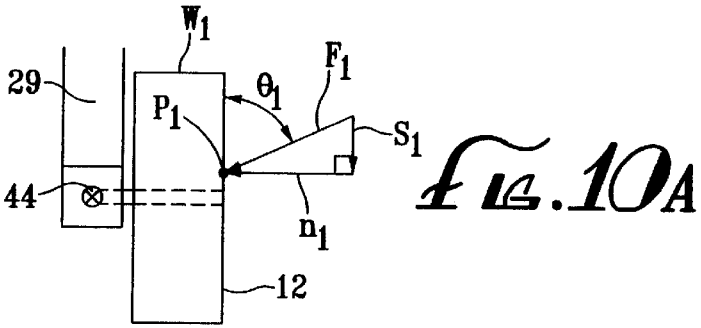
FIG. 10A shows a vector representation of the impingement force applied at point $P_1$ in FIG. 9A.
Figure 10B:
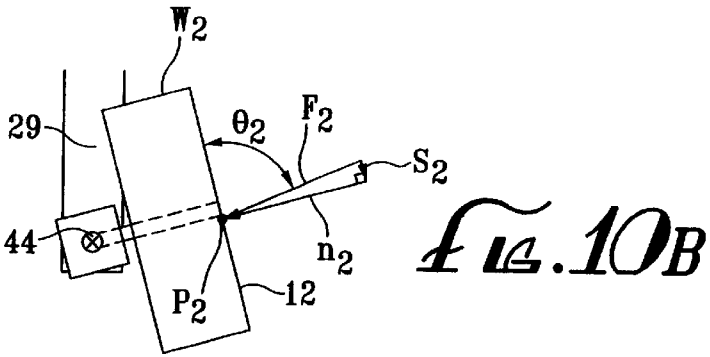
FIG. 10B shows a vector representation of the impingement force applied at point $P_2$ in FIG. 9B.
Figure 10C:
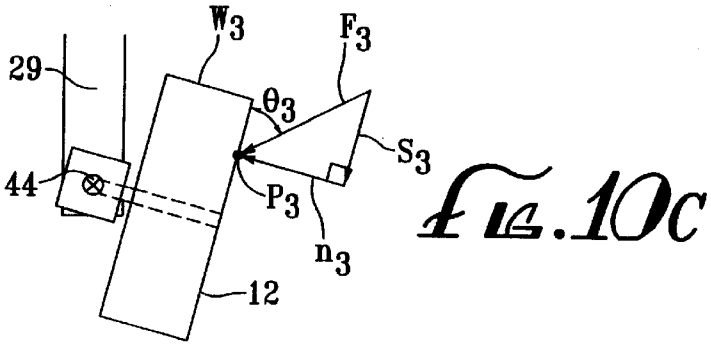
FIG. 10C shows a vector representation of the impingement force applied at point $P_3$ in FIG. 9C.

Details of the dynamic action by which the wheels 11 are rotated about respective wheel rotational axes 40 when the submerged portions 15 of the front faces 12 are impinged by the abrasive polishing media, are shown in FIGS. 9 and 10 depicting impingement on a representative wheel 11A. In particular, FIGS. 9A–C show top views of the representative wheel 11A in various angular positions. And FIGS. 10A–C show corresponding vector representations of FIGS. 9A–C.

As can be seen in FIG. 9A, the wheel 11A is in a default first angular position $W_1$, wherein the wheel mounting axle 35 and the wheel axis of rotation 40 are tangential to the orbital path 45 at the pivot axis 44. In this first angular position $W_1$, the front face 12 of the wheel 11A intersects the orbital path 45 at an intersection point $P_1$. The tangent line of the orbital path 45 at point $P_1$ is indicated at reference character $t_1$. As can be seen in FIG. 10A corresponding to a vector representation of FIG. 9A, an impingement force $F_1$ exerted by the abrasive polishing media at point $P_1$ of the front face 12 is in the direction of tangent line $t_1$. As depicted in FIG. 10A, the impingement force $F_1$ defines an impingement angle $\theta_1$, relative to the front face 12 of the wheel 11A. Furthermore, the impingement force $F_1$ has a normal force component $n_1$ providing the necessary impingement to effect abrasive finishing, and a frictional force component $s_1$ parallel to the front face 12 of the wheel 11A. It is the frictional force component $S_1$ which, when exerted against the submerged portion 15 of the wheel 11, provides the rotational moment to rotate the wheel 11A about its wheel rotational axis 40. Thus, and in this manner, all areas of the front face 12 may be cyclically submerged into the abrasive polishing media for impingement thereby. It is notable that the presence of the frictional force component $s_1$ is due to the less than ninety degree value of $\theta_1$. If the tangent line $t_1$ is normal to the front face 12 of the wheel 11A, the frictional force component $s_1$ would not be present to exert the rotational moment on the submerged portion 15 of the wheel 11A. It is also appreciated that while boundary layer impingement flow at the front face 12 may cause some degree of frictional flow, such considerations are beyond the scope of the present invention.

As shown in FIGS. 9B and 10B, the wheel 11A is pivoted inward to a second angular position $W_2$ such that the front face 12 of the wheel 11A intersects the orbital path 45 at an intersection point $P_2$. Similar to tangent line $t_1$ discussed above, the tangent line $t_2$ of the orbital path 45 at point $P_2$, likewise defines the direction of an impingement force $F_2$ applied at point $P_2$. As shown in FIG. 10B, a vector representation of FIG. 9B is shown where the force $F_2$ in the direction of tangent line $t_2$ forms an impingement angle $\theta_2$ with the front face 12 of the wheel 11*a*. Furthermore, the impingement force $F_2$ has a normal force component $n_2$ and a frictional force component $S_2$. Compared to the default first angular position $W_1$ above, however, the normal force component $n_2$ is greater than the normal force component $n_1$, and the frictional force component $S_2$ is substantially smaller than the frictional force component $S_1$ in FIG. 10A. Thus the second position shown in FIGS. 9B and 10B provides a greater impact force against the front face 12 compared to the impact force $n_1$ in FIGS. 9A and 10A. Moreover, the frictional force component $S_2$ in FIG. 10B provides a smaller rotational moment of the wheel 11 than $S_1$, thereby turning the wheel 11A at a slower angular rate than in the wheel orientation $W_1$ of FIGS. 10A and 9A.

And finally FIGS. 9C and 10C show the wheel 11A pivoted outward about pivot axis 44 to a third angular position $W_3$. In this third position $W_3$, the front face 12 of the wheel 11 intersects the orbital path 45 at an intersection point $P_3$. The resulting tangent line $t_3$ through the intersection point $P_3$ also defines the direction of the impingement force $F_3$ forming an impingement angle $\theta_3$ relative to the front face 12 of the wheel 11A. As shown in FIG. 10C, the impingement force $F_3$ also has a normal force component $n_3$ and a frictional force component $S_3$.

As can be seen by comparing force values in FIGS. 10A, 10B and 10C, the frictional force component $S_3$ is substantially greater than the frictional force components $S_1$ and $S_2$ of FIGS. 10A and 10B, respectively. Thus, the resulting rotational moment of the angular position $W_3$ in FIG. 10C would be substantially greater than the preceding two depictions to thereby rotate the wheel 11A at the fastest rotational rate. It is notable, however, that in the third angular position $W_3$, the normal force component $n_3$ is relatively smaller than the normal force components $n_1$ and $n_2$ of FIGS. 10A and 10B, respectively. The results of the foregoing discussions can be summed up by the mathematical relationship:

$$\text{for } 0<\theta_3<\theta_1<\theta_2<90 \text{ degrees,}$$

$$S_2<S_1<S_3;$$

and $$n_3<n_1<n_2.$$

Thus, for all impingement angles $\theta$ less than 90 degrees, greater wheel rotation about the wheel axis of rotation 40, indicated by S, may be realized as $\theta$ approaches zero. While not bound by any particular theory, it is believed, however, that below a certain critical impingement angle, the effective impingement area of the front face 12 is reduced such that greater carousel rpms may be required to sustain a desired level of impingement in the aggregate of the system.

In this manner, the wheels 11A–D may be pivotally adjusted to a desired impingement angle $\theta$ to provide an desired level of abrasive finishing at a given rpm of the central axis of rotation. It is notable that the angular rotation of the carousel hub 28 about the central axis of rotation is generally relatively low, i.e., within the range of 20 to 50 rpm, such that the abrasive polishing media may consistently impact only the submerged portions 15 of the wheel 11. One problem with rotating the central axis of rotation 26 at high rpms is that a transitional void may be produced by the wake of the impinged wheels 11, which may reduce the amount of abrasive polishing media impinging a follower wheel. It is further notable that the wheel finishing apparatus 10 may alternatively utilize means (not shown) for rotating the wheel about its wheel axis of rotation 40 whereby all areas of the front face 12 may be cyclically submerged in and impinged by the abrasive polishing media regardless of the impingement angle.

Furthermore, the degree of wheel submersion in the abrasive polishing media will generally be dictated by the particular configuration and application of the wheel finishing apparatus 10. Submerging a greater percentage of the front face 12 of each wheel 11 in the abrasive polishing media will impose greater torque requirements of the motor 21. Additionally, greater levels of submersion will also reduce the rotating effect of the wheels about their respective wheel axes of rotation 40. This is due to the associated reduction of the rotational moment exerted by the abrasive polishing media against the submerged portions 15 of the wheels 11. It is appreciated that submerging a wheel more than 50% of the front face in the abrasive polishing media will effectively reduce the rotational moment, until a zero rotational moment is reached when the wheel is completely submerged in the abrasive polishing media.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A wheel finishing apparatus for abrasively finishing wheels having front faces, said wheel finishing apparatus comprising:

a frame;

a carousel hub rotatably connected to said frame and having a central axis of rotation;

at least one carousel arm fixedly connected to the carousel hub and having a wheel mounting end remotely spaced from the central axis of rotation;

means for rotating the carousel hub about the central axis of rotation in a known direction of carousel rotation whereby the wheel mounting end of the at least one carousel arm traverses an orbital path around the central axis of rotation;

means for rotatably mounting a wheel to the wheel mounting end with the front face of the mounted wheel generally facing the known direction of carousel rotation and forming an impingement angle with the orbital path, said mounted wheel having a wheel axis of rotation normal to the front face of the mounted wheel, and said means for rotatably mounting a wheel, including means for securing the impingement angle at a fixed angle with respect to said orbital path;

a tank having an open end, for storing abrasive polishing media; and means for partially submerging the mounted wheel in the abrasive polishing media so that a submerged portion of the front face is in contact with the abrasive polishing media;

whereby partially submerging the mounted wheel in the abrasive polishing media and rotating the carousel hub about the central axis of rotation in the known direction of carousel rotation causes the abrasive polishing media to impinge the submerged portion of the front face of the mounted wheel at the impingement angle.

2. The wheel finishing apparatus as in claim 1, wherein the impingement angle is less than ninety degrees, whereby a rotational moment is exerted against the submerged portion of the front face to rotate the mounted wheel about its wheel axis of rotation and thereby impinge all areas of the front face in a cyclical manner.

3. The wheel finishing apparatus as in claim 1, further comprising means for pivoting the mounted wheel about a pivot axis generally parallel to the central axis of rotation at the wheel mounting end, for adjusting the impingement angle.

4. The wheel finishing apparatus as in claim 1, wherein the wheel finishing apparatus has a plurality of carousel arms, each extending from the carousel hub to a wheel mounting end.

5. The wheel finishing apparatus as in claim 1, wherein the carousel hub is rotatably connected to the frame in a suspended manner via a spindle having an upper end rotatably connected to the frame, and a lower end connected to the carousel hub.

6. The wheel finishing apparatus as in claim 5, wherein the means for rotating the carousel hub about the central axis of rotation is a carousel drive motor connected to the spindle.

7. The wheel finishing apparatus as in claim 1, wherein the means for partially submerging the mounted wheel in the abrasive polishing media includes hydraulic means for moving the tank and the wheel mounting end relative to each other.

8. A wheel finishing system for abrasively finishing wheels having front faces, said wheel finishing system comprising:

a wheel mounting structure means for rotatably mounting at least one wheel thereon, said at least one mounted wheel having a wheel axis of rotation normal to the front face;

a tank having an open end, for storing abrasive polishing media;

means for partially submerging the at least one mounted wheel in the abrasive polishing media so that a submerged portion of the front face is in contact with the abrasive polishing media; and means for relatively moving the at least one partially submerged wheel through the abrasive polishing media in a known direction of relative motion with the at least one partially submerged wheel angled to impinge the submerged portion of the front face at an impingement angle less than ninety degrees, said impingement angle defined between the known direction of relative motion and the front face of the at least one partially submerged wheel, and said impingement angle being securable at a fixed angle;

whereby the abrasive polishing media exerts a rotational moment against the submerged portion of the front face to rotate the partially submerged at least one wheel about its wheel axis of rotation and impinge all areas of the front face in a cyclical manner.

9. The wheel finishing system as in claim 8, further comprising means for pivoting the mounted at least one wheel about a generally vertical pivot axis, for adjusting the impingement angle.

10. The wheel finishing apparatus as in claim 8, wherein the means for partially submerging the mounted at least one wheel in the abrasive polishing media includes hydraulic means for moving the tank and the wheel mounting structure relative to each other.

11. A method for abrasively finishing the front faces of wheels in abrasive polishing media stored in a tank, said method comprising the steps of:

rotatably mounting at least one wheel to a wheel mounting structure, with the at least one mounted wheel having a wheel axis of rotation which is normal to the front face thereof, said wheel mounting structure permitting the free rotation of said wheel about its wheel axis of rotation;

partially submerging the at least one mounted wheel in the abrasive polishing media so that a submerged portion of the front face is in contact with the abrasive polishing media; and relatively moving the at least one partially submerged wheel through the abrasive polishing media in a known direction of relative motion with the at least one partially submerged wheel angled to impinge the submerged portion of the front face at an impingement angle less than ninety degrees, said impingement angle defined between the known direction of relative motion and the front face of the at least one partially submerged wheel, whereby the abrasive polishing media exerts a rotational moment against the submerged portion of the front face to rotate the at least one partially submerged wheel about its wheel axis of rotation and impinge all areas of the front face in a cyclical manner.

12. The method for abrasively finishing the front faces of wheels in abrasive polishing media as in claim 11, p1 wherein the wheel mounting structure has a carousel hub connected to a frame, said carousel hub having a central axis of rotation, and at least one carousel arm fixedly connected to the carousel hub and having a wheel mounting end remotely spaced from the central axis of rotation, wherein the step of relatively moving the at least one partially submerged wheel through the abrasive polishing media includes rotating the carousel hub about the central axis of rotation in a known direction of carousel rotation whereby the wheel mounting end traverses an orbital path around the central axis of rotation, and wherein the step of rotatably mounting at least one wheel to a wheel mounting structure includes the step of rotatably mounting a wheel to the wheel mounting end with the front face of the mounted wheel generally facing the known direction of carousel rotation and forming the impingement angle with the orbital path.

13. The wheel finishing method as in claim 11, wherein the step of partially submerging the mounted at least one wheel in the abrasive polishing media includes hydraulically moving the tank and the wheel mounting structure relative to each other.

14. The wheel finishing method as in claim 11, further including the step of adjusting the impingement angle by pivoting the partially submerged at least one wheel about a generally vertical pivot axis.

* * * * *